US006175223B1

(12) United States Patent
Martinez et al.

(10) Patent No.: US 6,175,223 B1
(45) Date of Patent: Jan. 16, 2001

(54) CONTROLLED LINEAR START-UP IN A LINEAR REGULATOR

(75) Inventors: Robert Martinez; Dale Skelton, both of Plano; David Grant, Dallas, all of TX (US)

(73) Assignee: Texas Instruments Incorporated, Dallas, TX (US)

( * ) Notice: Under 35 U.S.C. 154(b), the term of this patent shall be extended for 0 days.

(21) Appl. No.: 09/389,810

(22) Filed: Sep. 4, 1999

(51) Int. Cl.[7] ..... G05F 1/40
(52) U.S. Cl. ..... 323/274; 323/901; 323/281
(58) Field of Search ..... 323/274, 901, 323/908, 280, 281

(56) References Cited

U.S. PATENT DOCUMENTS 4,731,574 * 3/1988 Melbert ..... 323/275
5,079,497 * 1/1992 Barbu et al. ..... 323/281
5,532,576 * 7/1996 MacRobbie et al. ..... 323/274

* cited by examiner

*Primary Examiner*—Shawn Riley
(74) *Attorney, Agent, or Firm*—April M. Mosby; W. James Brady; Frederick J. Telecky, Jr.

(57) ABSTRACT

Provided is a linear voltage regulator and method of use thereof which controls the voltage input to an integrated circuit such as a digital signal processor (DSP) or a processor. The method includes the sequential steps of generating a first ramping voltage to a load connection when the load is in a start-up phase, and generating a second operating voltage to the load connection when the load is in an operational phase. The linear voltage regulator includes a control circuit and a regulation circuit that implements the method.

12 Claims, 2 Drawing Sheets

CONTROLLED LINEAR START-UP IN A LINEAR REGULATOR

CROSS REFERENCE TO RELATED APPLICATIONS

Cross reference is made to the following patent applications, each assigned to the same assignee, the teachings of which are incorporated herein by reference:

| Patent No. | Serial No. | Filing Date | Inventor | Title |
|---|---|---|---|---|
| TBD | 09/389,811 | 09/04/99 | Grant | Integration of Synchronous Rectifier Restoration of Boot Capacitor into Charge-Pump |
| TBD | 09/389,691 | 09/04/99 | Grant | Charge-Pump Closely Coupled to Switching Converter to Improve Area Efficiency |
| TBD | 09/389,809 | 09/04/99 | Grant, et al | Charge Pump Device And Method of Sequencing Charge-Pump Switches |

TECHNICAL FIELD OF THE INVENTION

This invention relates generally to a linear regulator, and more specifically to a low drop-out linear regulator that is used in an integrated circuit (IC), and that implements a method of dynamically controlling the voltage supplied to a device, such as a digital signal processor (DSP).

BACKGROUND OF THE INVENTION

As integrated circuit (IC) devices and IC circuits (collectively, IC circuitry—such as digital signal processors (DSPs) and mixed signal analog circuits, for example) continue to shrink in size and increase in complexity, more precise control of input voltages and input currents to IC circuitry is required. To control input voltages, modem IC circuitry utilize voltage regulators to insure that a relatively constant input voltage is maintained on the input to the IC circuitry. However, the miniaturization of IC circuitry has progressed to the point where constant input voltage regulation alone is not sufficient to insure the integrity and performance of the IC circuitry.

For example, when an IC circuitry starts-up, if the operational (steady-state) input voltage of the IC circuitry is immediately placed on the IC circuitry input, the IC circuitry may experience an excessive input current. This excessive input current may bum out transistors (called high in-rush current and may cause "over-voltage condition"), place undesired biases in the IC circuitry, and inject free electrons into the substrate of the IC circuitry. To limit the problems caused by an excessive input current, and to control other damaging effects of start-up operation, some regulators use two different regulation states (these are known as dual-mode voltage regulators). For example, one dual-mode voltage regulator uses current sources to place one fixed voltage on the input to the IC circuitry for a brief period of time, called a start-up phase. Then, after the start-up phase is complete, the dual-mode voltage regulator places a second fixed voltage (the operational voltage of the IC circuitry) on the input to the IC circuitry.

Unfortunately, the performance of prior-art voltage regulators, including dual-mode voltage regulators, is unsatisfactory and suffers from numerous disadvantages. For example, even small sudden changes in the input voltage can inject noise into the IC circuitry. In addition, though dual-mode voltage regulators reduce the damage caused by placing an operational voltage source directly on an IC circuitry, over-voltage conditions may still occur, free electrons may still be injected into the substrate, and the forwarding of back diodes can still occur. Also, the addition of the start-up phase in dual-mode voltage regulators increases the time it takes for an IC circuitry to become operational, which decreases the performance of the IC circuitry. Furthermore, dual-mode voltage regulators occupy a relatively large amount of IC wafer space. All of these factors contribute to reducing the performance and efficiency of the IC circuitry.

Therefore it is desired to have a voltage regulator circuit and a method for implementing a voltage regulator that provides safe start-up operations, increases start-up speeds, increases IC circuitry efficiency, prevents over-voltage conditions, and reduces the likelihood of noise injection in the IC circuitry, and electron injection into the substrate. The present invention provides such a device and method.

SUMMARY OF THE INVENTION

The present invention achieves technical advantages as a linear voltage regulator (sometimes called a low drop-out linear regulator, or LDO) and a method of operating a linear voltage regulator. The method ramps-up a voltage from zero volts to a target voltage during the start-up operation of an IC circuitry, and then provide a constant output voltage for the steady-state operation of the IC circuitry. The linear voltage regulator provides advantages over voltage regulators that are designed to simply maintain one constant output voltage, as well as regulators that use one fixed output voltage during the start-up operation of the IC circuitry, and then a second fixed output voltage during the steady-state operation of the IC circuitry. Accordingly, the disclosed linear voltage regulator provides the advantages of preventing high in-rush currents, over-voltage conditions, eliminating the forward-biasing of back-diodes, reduces electron injection into the substrate, reduces the likelihood of noise injection, provides faster start-up speeds, and increases IC circuitry efficiency.

The invention provides a method of operating a linear voltage regulator. The method begins with the step of generating a ramping voltage and applying the ramping voltage to a load via a load connection. The ramping voltage begins at ground voltage and increases linearly until a target voltage is reached. The time it takes to achieve the target voltage is controlled via a slow-start voltage generator. Next, the method proceeds to generate an operating voltage and applies the operating voltage to the load via the load connection.

The step of generating the ramping voltage is selected when a slow-start voltage of a control circuit is determined to be less than a reference voltage of the control circuit. Likewise, the step of generating the operating voltage is selected when a slow-start voltage of the control circuit determined to be is greater than or equal to an input voltage of the control circuit.

The present invention also provides a linear voltage regulator configuration. The linear voltage regulator has a control circuit and a regulation circuit coupled to the control circuit.

The control circuit includes a first switch coupled between a reference voltage input and an error amplifier node, and a second switch coupled between a slow-start voltage generator and the error amplifier node. The switches are implemented as PMOS transistors. The control circuit also provides a comparator for comparing the reference voltage to the slow-start voltage. The comparator has an output that is connected to the first switch to control said first switch. In addition, the control circuit has an inverter coupled to the output of the comparator. An output of the inverter is connected to the second switch to control said second switch. Furthermore, the control circuit includes an error amplifier for comparing an output voltage of the regulation circuit with the voltage on the error amplifier node, and also includes an output voltage driver for converting the output of the error amplifier to the appropriate input for the regulation circuit.

The regulation circuit includes an input node, an output node, and a variable resistance device (implemented as an NMOS transistor) coupled between the input node and the output node. A first capacitor coupled between the input node and a connection to ground, and a second capacitor coupled between the output node and the connection to ground are provided in the regulation circuit to provide a stiff-voltage. The variable resistance device is in communication with the control circuit to animate the linear voltage regulator.

BRIEF DESCRIPTION OF THE DRAWINGS

Other aspects of the invention, including alternative embodiments, are understood by reference to the following Detailed Description of a Preferred Embodiment, which can be better understood by reference to the drawings, in which.

DETAILED DESCRIPTION OF A PREFERRED EMBODIMENT

The linear voltage regulator of the present invention provides the advantages of preventing large in-rush currents, over-voltage conditions, eliminating the forward-biasing of back-diodes, reduces electron injection into the substrate, reduces the likelihood of noise injection, provides faster start-up speeds, and increases IC circuitry efficiency. This is accomplished by regulating the input voltage of the IC circuitry. The present invention recognizes that integrated circuit (IC) devices and IC circuits (collectively, IC circuitry) go through a start-up phase during which sudden, discrete changes to the input voltage of the IC circuitry can cause damaging currents to be generated within the IC circuitry, and accommodates for the start-up phase.

The present invention provides these advantages by using a linear voltage regulator (sometimes called a low drop-out linear regulator, or LDO) that operates in two states to control the input voltage to the IC device. In the first state, called the start-up operation, the linear voltage regulator ramps-up the input voltage (Vin) on the IC circuitry from zero volts to a target voltage (Vt). Once the target voltage is determined to be reached, a constant voltage is maintained at the input voltage connection to the IC circuitry in the second state. This second state is also called the steady-state operation. Accordingly, the linear voltage regulator provides advantages over voltage regulators that are designed to operate at one or two fixed output voltages.

Figure 1:
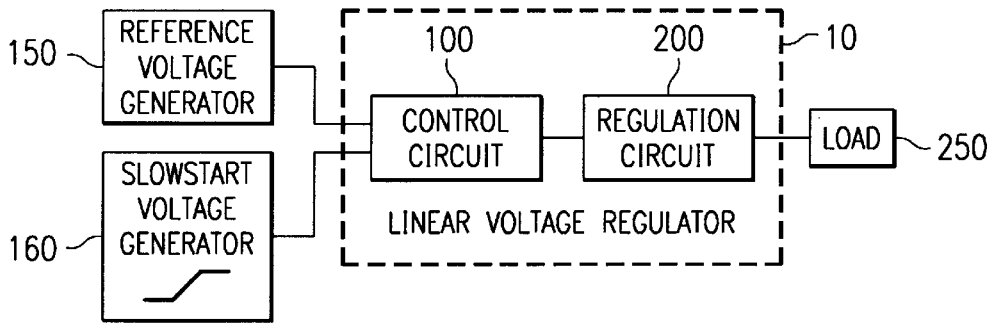
FIG. 1 is a block diagram of a system which incorporates the invention and controls the voltage input on a load.

The linear voltage regulator of the present invention may be implemented in conjunction with a number of IC circuitry, such as digital signal processors (DSPs) and mixed signal analog circuits such as switch mode converters. FIG. 1 is a block diagram of a system which incorporates the invention and controls the voltage input on a load. Generally, the linear voltage regulator 10 provides a predetermined, controlled output voltage to a load 250, which is typically IC circuitry, through a regulation circuit 200 as a function of the output voltage to the load, creating a feedback circuit. The output voltage of the regulation circuit (Vout) is the input voltage to the IC circuitry (Vin). Additionally, the linear voltage regulator 10 provides specifically shaped waveforms to the load, depending on the detected Vout.

The Vout of the linear voltage regulator 10 is a unique amplification of smaller, specific waveform shapes. These waveform shapes are predetermined, and typically several will be available to the linear voltage regulator 10. Then, in operation, a specific waveform shape can be chosen during a specific IC circuitry phase to match the performance requirement of the load being regulated.

Typically, a waveform shape is created by independent circuitry that may exist on the IC circuitry, or in an independent device off the IC circuitry. Then, the desired waveform shape is selected by a control circuit 10, based on the known demands of the load 250, and other desired performance choices. For this embodiment, a slow-start voltage generator 160 is chosen to provide the control circuit 100 with a ramp-type input waveform shape. Accordingly, when started, the slow-start voltage generator 160 linearly ramps up from a slow-start voltage (Vss) OV to a predetermined maximum voltage (Vmax). The chosen time period it takes for the voltage to complete the rise exceeds at least the time period required by the start-up phase of the IC circuitry. The time period of the rise from Vss determines the length of the start-up phase, as discussed below, and is selected by a design engineer based on the start-up time needed by the load (typically, to avoid damaging load components). Thus, these start-up times are implemented through the engineering of the circuitry of the slow-start voltage generator 160. This embodiment also includes a reference voltage generator 150 that produces a constant reference voltage (Vref) for the control circuit 100 to evaluate and compare against.

The voltage of the reference voltage generator 150 and the voltage of slow-start voltage generator 160 are compared by the control circuit 100, which, in the present embodiment, selects the lower voltage of the Vref or Vss to determine the input voltage to be placed on the load 250. The input voltage is then responsively set to the estimated value by the regulation circuit 200. Each of these devices may be implemented together as a group on a single IC, or separately.

Figure 2:
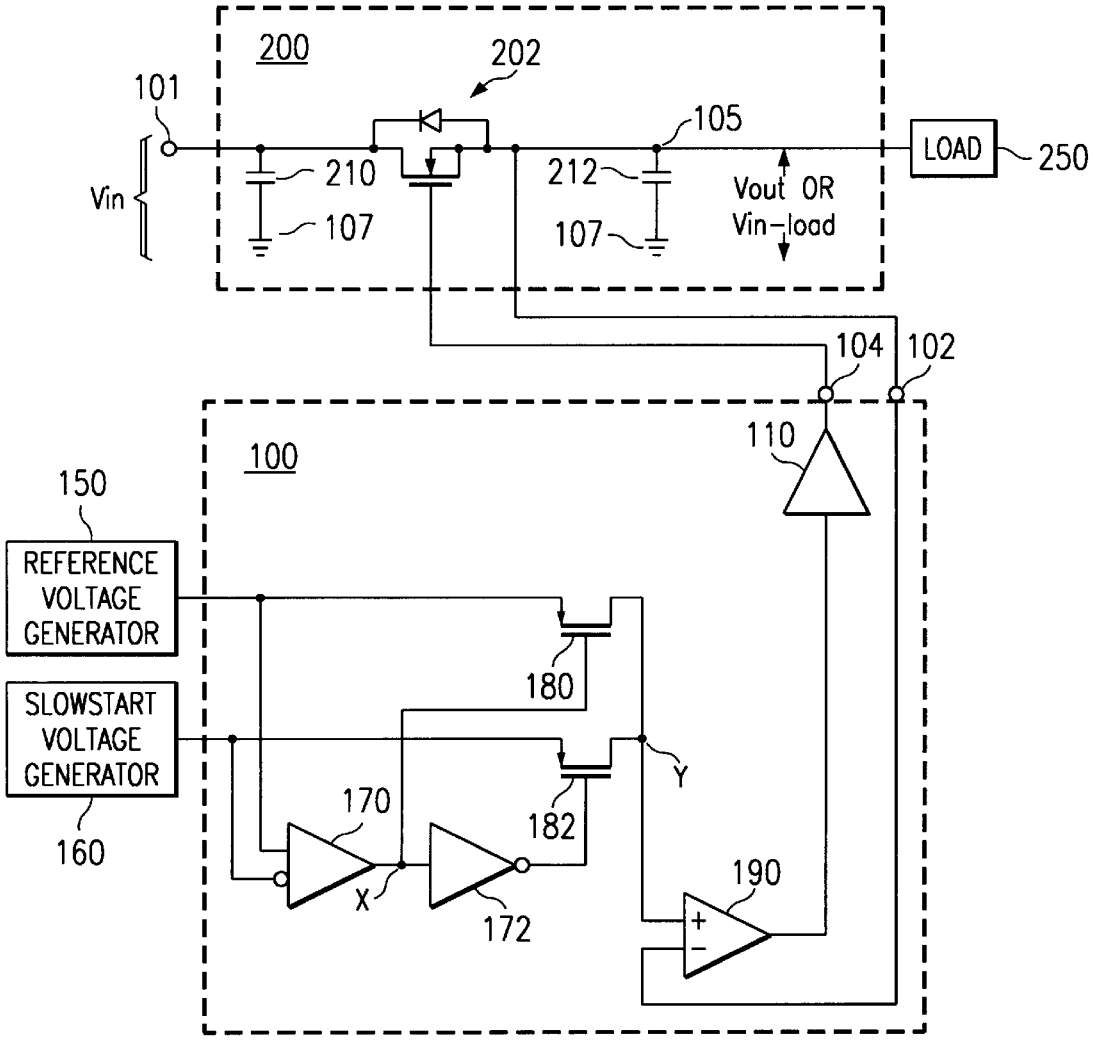
FIG. 2 is a simplified circuit diagram of the present invention's linear voltage regulator.

FIG. 2 is a simplified circuit diagram of the linear voltage regulator 10 of the present invention. In particular, in FIG. 2, the control circuit 100 and the regulation circuit 200 are shown in greater detail.

The regulation circuit 200 generally comprises an input node 101, a first capacitor 210 coupled between the input node 101 and a connection to ground 107, a variable resistance device 202 coupled between the input node 101 and an output node 105, and a second capacitor 212 coupled between the output node 105 and the connection to ground 107. The frrst capacitor 210 and the second capacitor 212 are used to buffer any voltage changes at the input node 101 or the output node 105, and thus help maintain a stiff voltage at the input node 101 or the output node 105. A stiff voltage means that a voltage is maintained at a node of attachment. The variable resistance device 202, also called a pass-device is shown implemented as a NMOS transistor. It should be noted, however, that the variable resistance device 202 can be implemented as other devices as well such as a FET, a BJT, or other devices which are known in the art. The resistance of the variable resistance device 202 is controlled via a gate voltage applied to the gate of the variable resistance device 202. The gate voltage is applied through a feedback loop created via the output node connection 102 to the control circuit 200, and via the control circuit node connection 104 to the variable resistance device 202 in the regulation circuit 100.

The control circuit 100 has a comparator 170 comparing the voltage produced by the reference voltage generator 150 to the voltage produced by the slow-start voltage generator 160. The control circuit also has a first switch 180, which is shown to be implemented as a PMOS transistor, and a second switch 182 which also shown to be implemented as a PMOS transistor. When the first switch 180 is closed, it conducts current between the reference voltage generator 160 and an error amplifier node Y. When the second switch 182 is closed, it conducts current between the slow-start voltage generator 160 and the node Y.

To control the opening and closing of the switches 180 and 182, and to prevent voltage conflicts at the node Y, the output of the comparator 170 is coupled to and drives the gate of the first switch 180. An inverter 172 is coupled between the output of the comparator 170 and the gate of the second switch 182 to control the second switch 182. Thus, when the first switch 180 is closed, the second switch 182 is open, and when the first switch 180 is open, the second switch 182 is closed. An error amplifier 190 is coupled to the node Y, and also receives feedback from the output node 105 of the regulator circuit 200. The output of the error amplifier 190 is connected to an output voltage driver 110, which increases the output of the error amplifier 190, which may be a voltage or a current, which determines the appropriate output, typically either a voltage or a current, needed to drive the variable resistance device 202 of the regulation circuit 200.

Figure 3:
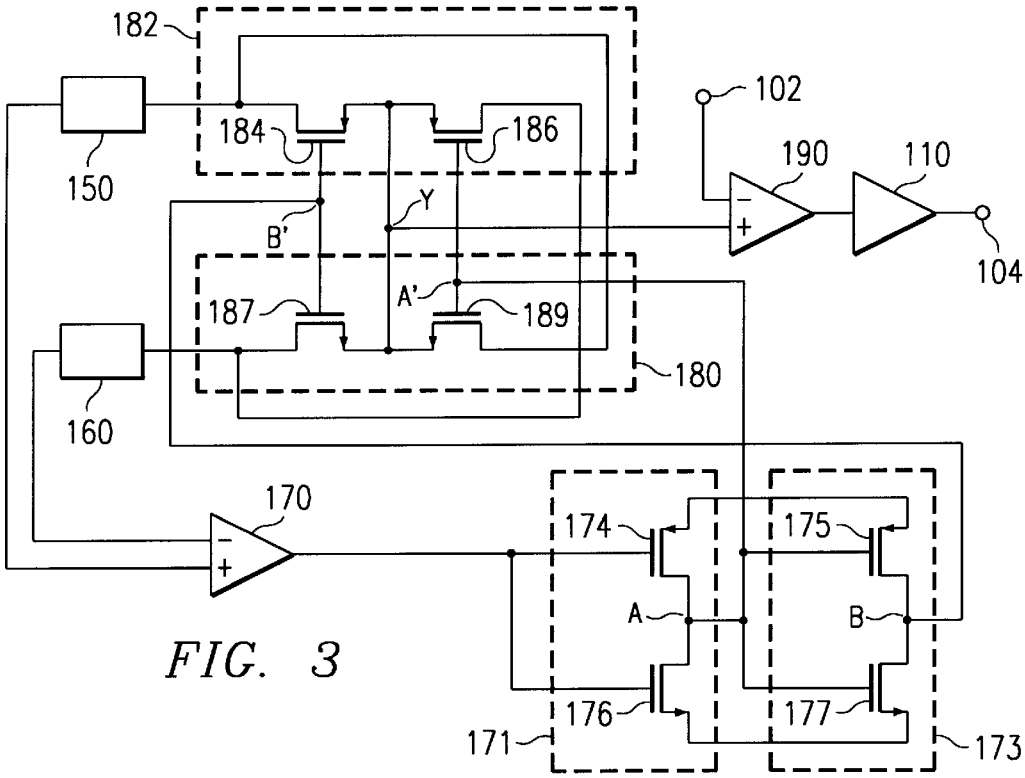
FIG. 3 is a schematic of a linear voltage regulator designed according to the teachings of the present invention.

FIG. 3 is a schematic of linear voltage regulator 10 designed according to the teachings of the present invention. FIG. 3 illustrates the control circuit 100 in greater detail, and, more specifically, further defines the inverter 172, the first switch 180, and the second switch 182.

From FIG. 3 it is seen that the inverter 172 is implemented as a first inverter 171 and a second inverter 173. The first inverter 171 is comprised of a first PMOS transistor 174 which is drain-to-drain connected to a first NMOS transistor 176. The gate at the first PMOS transistor 174 and the gate at the first NMOS transistor 176 are both connected to the output of the comparator 170. The second inverter 173 is comprised of a second PMOS transistor 175 and a second NMOS transistor 177, which are connected drain-to-drain. The gates of the second PMOS transistor 175 and the second NMOS transistor 177 are connected to the drains of the first PMOS transistor 174 and the first NMOS transistor 176 to form common node A. The drains of the second PMOS transistor 175 and the drain of the second NMOS transistor 177 are connected together to form node B.

The switches of the control circuit 100 are also shown implemented as transistor devices. The first switch 180 (shown as dashed lines) is seen to comprise a first NMOS transistor 187 and a second NMOS transistor 189 which are connected source-to-source to form the node Y. The gate of the first NMOS transistor 187 is driven by the node B. The gate of the second NMOS transistor 189 is driven by the node A. The second switch 182 (shown as dashed lines) is seen to comprise a first PMOS transistor 184 and a second PMOS transistor 186. The first PMOS transistor 184 is driven by the node B. The gate of the second PMOS transistor 186 is controlled by the node A. Of course, although the inverters 171, 173 and the switches 180, 182 are shown implemented as MOS transistors, it should be understood that the inverter and the switches can be implemented at any time of solid state device, such as FETs, BJTs, or other devices.

Figure 4:
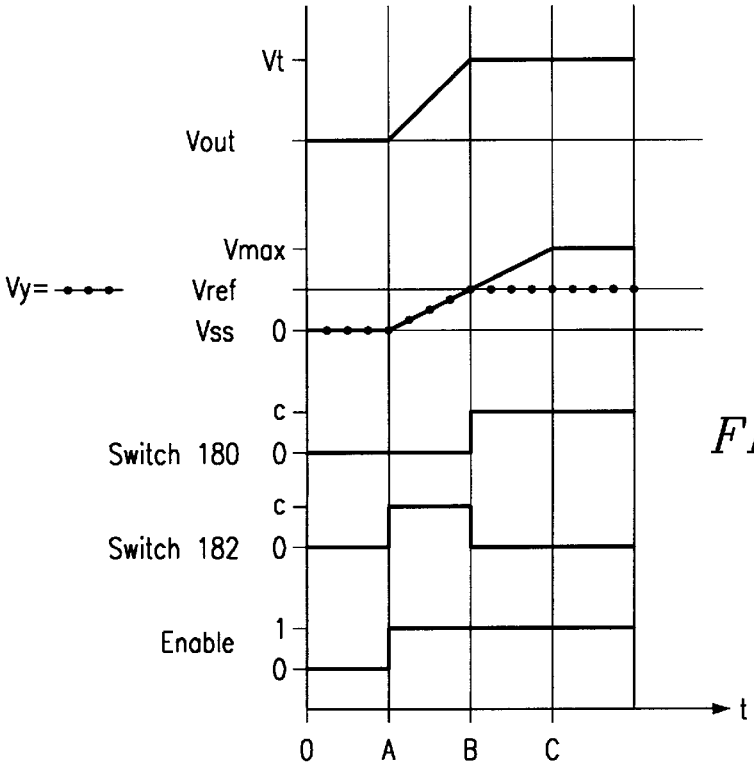
FIG. 4 is a timing diagram illustrating functional events that take place in a linear voltage regulator during start-up and steady-state operation according to the present invention.

FIG. 4 is a timing diagram illustrating events that take place in the linear voltage regulator 10, implementing one waveform shape during start-up IC circuitry operation and a second waveform shape during steady-state IC circuitry operation according to the present invention. In FIG. 4 time-dependent events are indicated along the horizontal axis for each event identified by a capital letter A, B, and C. Although each event, A through C, is order dependent, in no way should the timing diagram be construed as requiring that the events happen at specific relative times. For example, the time between event A and event B may be the same, greater than, or less than the time between event B and event C or the time between event O and event A, etc.

Output states or voltages of individual devices are identified up the vertical axis. The state of a switch (either open or closed) is indicated by an event line corresponding to an O for (Opened) or a C for (Closed). Accordingly, when a switch's event line corresponds to the switch's O position the switch is open. Likewise, when the switch's event line corresponds to that switch's C position, that switch is closed. The enable line indicates when the IC circuitry is "off" with a line that corresponds to 0, and then indicates when the IC circuitry is "on" when the enable line corresponds to 1. Vy, illustrated with dotted lines, indicates the voltage at node Y (which is the voltage entering the error amp 190). $V_{ref}$ is the voltage produced by a reference voltage generator 150, and $V_{ss}$ is the voltage produced by the slow-start generator 160. $V_{out}$ is the output voltage on output node 105 which is also the input voltage (Vin-load) to the load 250.

At time t=0 the IC circuitry is not enabled. Accordingly, the first gate 180 and the second gate 182 are open, and the voltages on the node Y and the output node 105 are 0. Then, at time t=A, the event A takes place when the IC circuitry becomes enabled, indicated by the step-up of the enable line to logic 1. This begins the s*p-1Xtart-up operation. The first comparator 170 detects that the voltage produced by the slow-start voltage generator 160, Vss, is less than the voltage produced by the referenced voltage generator 150, Vref, and responsively closes the first switch 182 to pass Vss to the error-amplifier 190. The error-amplifier 190 compares Vss to Vout and then passes the difference between the two to the output voltage driver 110. The output voltage driver 110 produces the appropriate output to place the correct resistance in the regulation circuit 200. As shown at t=A, this causes Vout to begin to rise at time t=A.

Next, event B takes place at time t=B, when the target voltage (Vt) is reached on the output node 105, signaling the end of the start-up operation and the beginning of the steady-state operation. The IC circuitry continues to be enabled and will continue to be enabled hereinafter during the steady-state operation. At time t=B the first comparator 170 detects that the voltage produced by the slow-start voltage generator 160 is about to exceed the voltage produced by the reference voltage generator 150. Responsively, the output of the first comparator 170 changes, causing the first switch 180 to open and the second switch 182 to close. Accordingly, switch 180 passes the voltage of the reference voltage generator 150 to the node Y. Again, the error amplifier compares the value of node Y and the output node 105 to produce an output which is used by the output voltage driver 110 to produce the appropriate output voltage ( Vout) in the regulation circuit 200. By this time the end of the start-up phase, Vout has reached the target voltage, Vt, and no further increase in the output voltage is desired though Vt should be maintained on the output node 105.

The next event takes place at time t=C when the voltage produced by the slow-start generator 160 reaches its maximum. However, at time C, steady state operation is already achieved, making this event trivial. The first comparator 170 continues to detect that the voltage produced by the slow-start voltage generator 160 to exceed the reference produced by reference voltage generator 150, and maintains switch 180 in the closed position. Thus, switch 180 conducts the Vref to the error amplifier 190.

Thus, it is seen that the output voltage, Vout, at the output node 105 tracks the voltage at node Y by the selection of a waveform shape by the control circuit 100. The control circuit 100 then directs the regulation circuit to place a desired Vout on an output node 105 to provide the predetermined input voltage to the load 250. This can be seen by comparing the graphical illustration of Vout to the graphical illustration of the node Y as shown by the dots in FIG. 4.

Though the invention has been described with respect to a specific preferred embodiment, many variations and modifications will become apparent to those skilled in the art upon reading the present application. It is therefore the intention that the appended claims be interpreted as broadly as possible in view of the prior art to include all such variations and modifications.

We claim:

1. A method of operating a linear voltage regulator having a control circuit and a regulation circuit, comprising the sequential steps of:

generating a first ramping voltage; and generating a second operating voltage, wherein the control circuit generates a slow-start voltage and a reference voltage, further comprising a step of generating the second operating voltage when the slow-start voltage of the control circuit is greater than or equal to the input voltage of the control circuit.

2. The method of claim 1 wherein the method uses the linear voltage regulator comprising:

a control circuit having a first switch coupled between a reference voltage input and an error amplifier node, a second switch coupled between a slow-start voltage generator and the error amplifier node, a comparator for comparing the reference voltage to the slow-start voltage, an output of the comparator being connected to the first switch to control said first switch, an inverter coupled to the output of the comparator, an output of the inverter being connected to the second switch to control said second switch, and an error amplifier for comparing an output voltage of the regulation circuit with the voltage on the error amplifier node; and a regulation circuit having an input node, an output node, and a variable resistance device coupled between the input node and the output node.

3. A method of applying a voltage to an integrated circuit (IC) device using a voltage regulator, comprising the sequential steps of:

applying a first generally ramping voltage to the IC circuitry; and applying a second generally constant voltage to the IC circuitry, wherein the control circuit generates a slow-start voltage and a reference voltage, further comprising a step of applying the first ramping voltage when the slow-start voltage of a linear voltage regulator control circuit is less than the reference voltage of the linear voltage regulator control circuit.

4. A method of applying a voltage to an integrated circuit (IC) device using a voltage regulator, comprising the sequential steps of:

applying a first generally ramping voltage to the IC circuitry; and applying a second generally constant voltage to the IC circuitry, wherein the control circuit generates a slow-start voltage and a reference voltage, further comprising a step of generating the second operating voltage when the slow-start voltage of the control circuit is greater than and equal to the input voltage of the linear voltage regulator control circuit.

5. A linear voltage regulator, comprising:

a control circuit; and a regulation circuit providing an output voltage to the control circuit, said regulation circuit providing a ramping voltage and an operating voltage, wherein the regulation circuit further comprises:

a first switch coupled between a reference voltage input and an error amplifier node;

a second switch coupled between a slow-start voltage generator and the error amplifier node;

a comparator coupled to said reference voltage input and the slow-start voltage generator comparing the reference voltage to the slow-start voltage, the compactor having an output;

an inverter coupled to the output of the comparator, the inverter having an output, wherein the comparator output is connected to control one of said first switch or said second switch, and the inverter output is connected to control the other said first or second switch; and an error amplifier comparing the output voltage of the regulation circuit with the voltage on the error amplifier node.

6. The linear voltage regulator of claim 5 further comprising an output voltage driver coupled between the output of the error amplifier and the regulation circuit.

7. The linear voltage regulator of claim 5 wherein the first switch is a PMOS transistor.

8. The linear voltage regulator of claim 5 wherein the second switch is a PMOS transistor.

9. The linear voltage regulator of claim 5 wherein the regulation circuit further comprises:

an input node;

an output node; and a variable resistance device coupled between the input node and the output node, said variable resistance device being coupled to said error amplifier.

10. The linear voltage regulator of claim 9 further comprising a first capacitor coupled between the input node and a connection to ground, and a second capacitor coupled between the output node and the connection to ground.

11. The linear voltage regulator of claim 9 wherein the variable resistance device is a NMOS transistor.

12. The linear voltage regulator of claim 9 wherein the variable resistance device is in communication with the control circuit.

* * * * *